US009185977B2

(12) United States Patent
Lupa

(10) Patent No.: US 9,185,977 B2
(45) Date of Patent: Nov. 17, 2015

(54) FURNITURE SKID PLATE

(71) Applicant: Donald S Lupa, North Aurora, IL (US)

(72) Inventor: Donald S Lupa, North Aurora, IL (US)

(73) Assignee: SD Machinery, LLC, North Aurora, IL (US)

( * ) Notice: Subject to any disclaimer, the term of this patent is extended or adjusted under 35 U.S.C. 154(b) by 0 days.

(21) Appl. No.: 13/682,400

(22) Filed: Nov. 20, 2012

(65) Prior Publication Data

US 2013/0125342 A1 May 23, 2013

Related U.S. Application Data

(60) Provisional application No. 61/563,029, filed on Nov. 22, 2011.

(51) Int. Cl.
*A47B 91/00* (2006.01)
*A47B 91/06* (2006.01)

(52) U.S. Cl.
CPC ..... *A47B 91/06* (2013.01); *Y10T 16/191* (2015.01)

(58) Field of Classification Search
CPC ..... A47B 91/06; A47B 91/04; A47B 91/00; A47B 91/024; A47C 7/002
USPC ..... 16/42 R, 42 T; 248/188.8, 188.9, 188.3, 248/346.07
See application file for complete search history.

(56) References Cited

U.S. PATENT DOCUMENTS 835,492 A * 11/1906 Baker ..... 16/30
1,159,570 A * 11/1915 Clark ..... 248/188.8
1,179,811 A * 4/1916 Diss ..... 16/42 R
1,230,836 A * 6/1917 Ballenberg ..... 16/42 R
1,401,304 A * 12/1921 Becker ..... 24/186
1,420,602 A * 6/1922 Wujek ..... 16/42 R
1,757,963 A * 5/1930 Herold ..... 16/42 R
1,928,933 A * 10/1933 Goldberg ..... 248/188.9
2,175,317 A * 10/1939 Rogers ..... 16/30
2,431,780 A * 12/1947 Theal ..... 224/157
2,529,390 A * 11/1950 Hauer ..... 16/29
2,626,456 A * 1/1953 Harrison ..... 428/572
2,875,552 A * 3/1959 Stillman ..... 248/188.9
2,886,918 A * 5/1959 Bayley et al. ..... 248/188.9
2,968,116 A * 1/1961 Arenson ..... 248/188.9
3,025,105 A * 3/1962 Nash ..... 297/239
3,108,393 A * 10/1963 Baker ..... 248/345.1
3,191,212 A * 6/1965 Hahn et al. ..... 16/42 R
3,329,747 A * 7/1967 Veach ..... 264/31
3,381,331 A * 5/1968 Reynolds ..... 16/42 R
3,389,421 A * 6/1968 Wheeler ..... 16/42 R
3,805,473 A * 4/1974 Lidgard ..... 53/397
4,099,770 A * 7/1978 Elsholz et al. ..... 297/216.11
4,237,174 A * 12/1980 Lagardere et al. ..... 428/99
4,501,402 A * 2/1985 Saito et al. ..... 248/346.02
5,503,492 A * 4/1996 Stevens et al. ..... 403/297
D371,837 S * 7/1996 Coble ..... D23/386

(Continued)

*Primary Examiner* — Victor Batson
*Assistant Examiner* — Jason W San
(74) *Attorney, Agent, or Firm* — Fitch, Even, Tabin & Flannery LLP

(57) ABSTRACT

A furniture skid plate to transport and protect a piece of furniture or a cabinet that includes a general triangular shape base skid plate that includes a bottom surface with a bottom perimeter and a top surface with a top perimeter, a pair of linear rail protrusions that protrude upward and are disposed on the top perimeter of the base skid plate and are in contact with furniture or appliance transported and a pair of indentations that are disposed on the bottom surface of the base skid plate.

21 Claims, 3 Drawing Sheets

(56) References Cited

U.S. PATENT DOCUMENTS

| | | | | | |
|---|---|---|---|---|---|
| 5,557,824 | A * | 9/1996 | Bushey | 16/42 R |
| 5,680,673 | A * | 10/1997 | Beshore | 16/42 R |
| 5,782,444 | A * | 7/1998 | Anderman et al. | 248/188.8 |
| 5,791,281 | A * | 8/1998 | Davidson | 114/377 |
| D400,780 | S * | 11/1998 | Wurdack | D8/374 |
| 5,868,372 | A * | 2/1999 | Novak et al. | 248/346.11 |
| 5,881,979 | A * | 3/1999 | Rozier et al. | 248/188.5 |
| 5,988,743 | A * | 11/1999 | Drexler | 297/250.1 |
| 6,058,852 | A * | 5/2000 | Estvanko | 108/55.3 |
| 6,095,463 | A * | 8/2000 | McCormick | 248/188.4 |
| 6,161,885 | A * | 12/2000 | Walker | 294/31.2 |
| 6,405,982 | B2 * | 6/2002 | Ferencz | 248/188.9 |
| 6,883,530 | B2 * | 4/2005 | Kawakami | 135/84 |
| 6,901,629 | B2 * | 6/2005 | Wurdack | 16/42 R |
| 6,953,214 | B2 * | 10/2005 | Paz | 294/157 |
| 7,237,302 | B2 * | 7/2007 | Bushey | 16/32 |
| 7,331,493 | B2 * | 2/2008 | Dent, III | 224/157 |
| D581,162 | S * | 11/2008 | Walker et al. | D3/327 |
| 7,841,635 | B2 * | 11/2010 | Fuchs | 294/150 |
| 7,921,679 | B2 * | 4/2011 | Jo | 68/3 R |
| 7,993,083 | B1 * | 8/2011 | Abney | 410/100 |
| 8,146,516 | B2 * | 4/2012 | Linares | 108/57.25 |
| 8,196,527 | B2 * | 6/2012 | Linares | 108/57.25 |
| 8,262,054 | B2 * | 9/2012 | Stansbury | 248/677 |
| 2005/0035266 | A2 * | 2/2005 | Stansbury | 248/676 |
| 2007/0131726 | A1 * | 6/2007 | Aliev | 224/184 |
| 2007/0234507 | A1 * | 10/2007 | Vorpahl | 16/42 R |
| 2008/0209685 | A1 * | 9/2008 | Dombroski et al. | 16/42 R |
| 2009/0025184 | A1 * | 1/2009 | Clarke | 16/42 T |
| 2010/0018005 | A1 * | 1/2010 | Bushey | 16/42 T |
| 2010/0025445 | A1 * | 2/2010 | Brunson et al. | 224/579 |
| 2010/0181793 | A1 * | 7/2010 | Lopreiato | 294/152 |
| 2013/0081970 | A1 * | 4/2013 | Dietvorst | 206/494 |
| 2013/0119097 | A1 * | 5/2013 | Nielsen | 224/157 |
| 2013/0125342 | A1 * | 5/2013 | Lupa | 16/30 |

* cited by examiner

FURNITURE SKID PLATE

This application claims priority to U.S. Provisional Application 61/563,029 filed on Nov. 22, 2011, the entire disclosure of which is incorporated by reference.

TECHNICAL FIELD & BACKGROUND

Furniture moving has always been a difficult and physically demanding job. Many times furniture movers utilize relatively crude dollies or wood blocking to place under any furniture or a cabinet to be transported that can often result in damage to the furniture, the cabinet or flooring being transported on.

The present invention generally relates to a skid plate. More specifically, the invention is a furniture skid plate that protects a bottom portion of a piece of furniture or a cabinet while it is being transported.

It is an object of the invention to provide a furniture skid plate that bridges one or more gaps of uneven surfaces with relative ease of use and a smooth gliding motion.

It is an object of the invention to provide a furniture skid plate that provides a relatively strong attachment of a piece of furniture or a cabinet to the furniture skid plate providing relative consistent reliability.

It is an object of the invention to provide a furniture skid plate with a plurality of tapered edges that helps the skid plate travel over one or more uneven surfaces with a relatively larger, flatter, and smoother contact area.

What is really needed is a furniture skid plate that provides a relatively strong attachment of a piece of furniture or a cabinet to the furniture skid plate providing relative consistent reliability that provides a relatively strong attachment of a piece of furniture or a cabinet to the furniture skid plate providing relative consistent reliability that helps the skid plate travel over one or more uneven surfaces with a relatively larger, flatter, and smoother contact area.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments. Various operations will be described as multiple discrete operations, in turn, in a manner that is most helpful in understanding the present invention; however, the order of description should not be construed as to imply that these operations are necessarily order dependent. In particular, these operations need not be performed in the order of presentation. The phrase "in one embodiment" is used repeatedly. The phrase generally does not refer to the same embodiment, however, it may. The terms "comprising", "having" and "including" are synonymous, unless the context dictates otherwise.

Figure 1A:
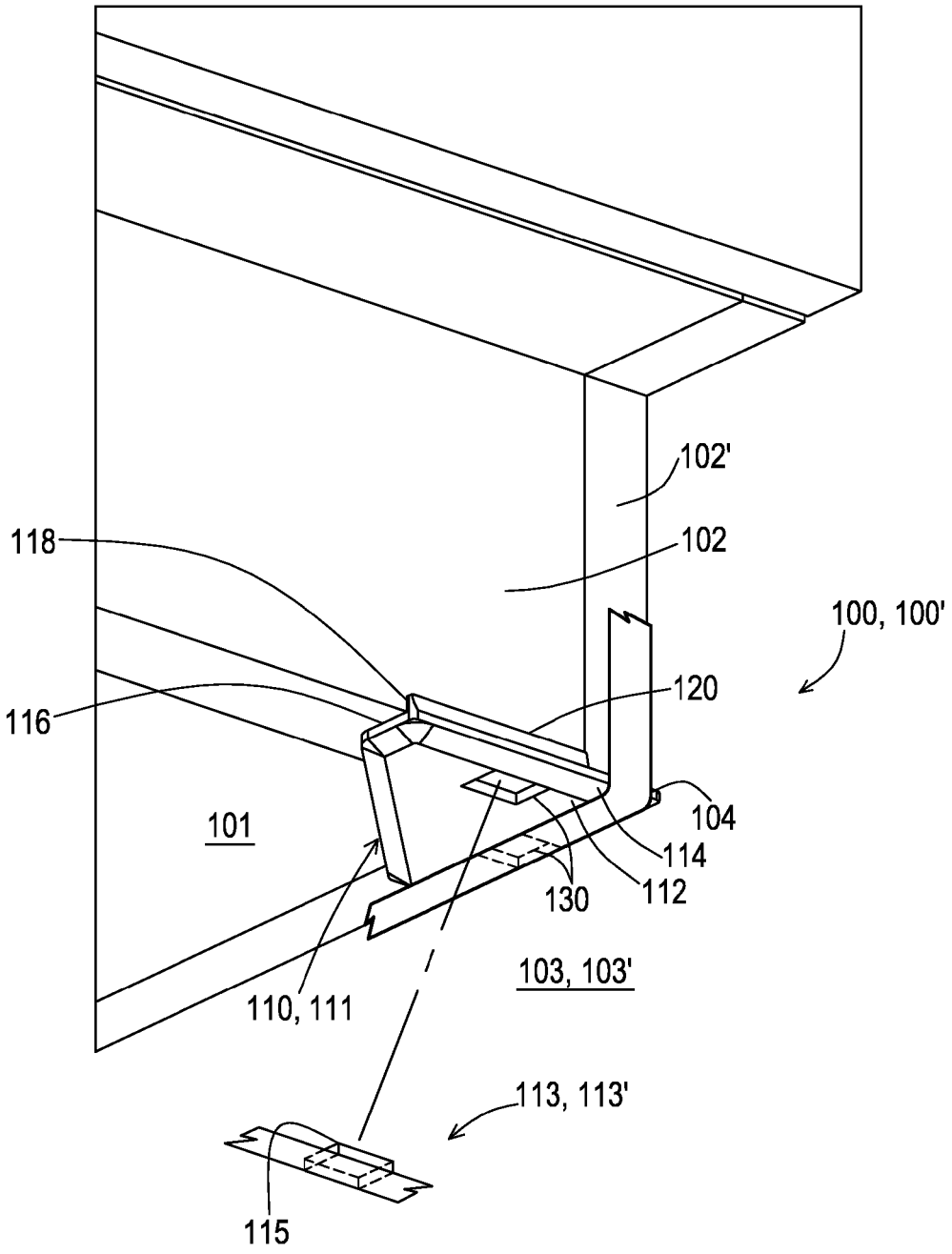
FIG. 1A illustrates an environmental bottom perspective view of a furniture skid plate, in accordance with one embodiment of the present invention.

FIG. 1A illustrates an environmental bottom perspective view of a furniture skid plate 100, in accordance with one embodiment of the present invention. The furniture skid plate 100 illustrated and described in FIG. 1A and its description is 1 furniture skid plate 100 that is removably attached on a bottom corner 104 of a bottom surface 101 of a piece of furniture 102 that is being transported and protected by the furniture skid plate 100. The term removably attached is defined as being attached to an object but with the capability of being removed. In other words the base skid plate 110 is removably attached to the one or more bottom corners 104 of a piece of furniture 102. Typically the base skid plate 110 is removed by simply picking the base skid plate 110 off of the one or more bottom corners 104 of the piece of furniture 102 by hand however other suitable procedures can be utilized to remove the base skid plate 110 from the one or more bottom corners 104 of a piece of furniture 102. The furniture skid plate 100 includes a base skid plate 110, a plurality of linear side rails 120 and one or more indentations 130. The base skid plate 110 10 has a bottom surface 112 with a bottom beveled perimeter 114 and a top surface 116 with a top perimeter 118. The piece of furniture 102 transported by the furniture skid plate 100 can be any suitable piece of furniture 103 that can rest on the top surface 116 of the base skid plate 110 such as a cabinet 102' or a set of dresser drawers (not shown). One or more furniture skid plates 100 can be utilized to facilitate transporting a piece of furniture 102 along a ground surface 103 such as a floor 103' and to protect the bottom surface 101 of the piece of furniture 102 from damage while being transported, which is typically by sliding the piece of furniture 102 on the ground surface 103 such as a floor 103' with the one or more furniture skid plates 100 removably attached to the one or more bottom corners 104 of the piece of furniture 102. The base skid plate 110 has a general triangular shape 111 that is well-suited to be removably attached to and fit onto the bottom corner 104 of a piece of furniture 102. The general triangular shape 111 also makes the base skid plate 110 easy to handle and place underneath a piece of furniture 102 being transported and protected. The top perimeter 118 of the base skid plate 110 has a plurality of linear side rails 120 which protrude upward at an approximate 90 degree angle from the top perimeter 118 of the base skid plate 110 and allow a user to relatively easily place a piece of furniture 102 onto the base skid plate 110 and to allow the base skid plate 110 to slide over any rough surface, bumps, pits, holes or any other imperfections on a ground surface 103 such as a floor 103' that the base skid plate 110 is sliding on. FIG. 1A illustrates 2 linear side rails 120 however any suitable number of linear side rails can protrude upward at an approximate 90 degree angle from the top perimeter 118 of the base skid plate 110. The linear side rails 120 are molded to the top perimeter 118 of the base skid plate 110 and exert pressure on the bottom corner 104 of the piece of furniture 102 to allow the base skid plate 110 to be removably attached to the bottom corner 104 of the piece of furniture 102. The linear side rails 120 protrude upward and have a height of approximately ⅛th of an inch or any other suitable height. The linear side rails 120 are approximately 2 inches in length but can be any suitable length. The one or more indentations 130 are disposed on the bottom surface 112 of the base skid plate 110 and accommodate the one or more fasteners 113 such as one or more attachment belts 113' or an attachment device (not shown) that is inserted into the one or more indentations 130 that is wrapped around the piece of furniture 102 to attach the furniture skid plate 100 to the piece of furniture 102. The one or more indentations 130 are recessed to accommodate one or more fasteners 113 below a ground surface 103 so when the furniture skid plate 100 is slid across the ground surface 103, the one or more fasteners 113 do not scratch or drag on the ground surface 103.

FIG. 1A illustrates 2 indentations 130 although the one or more indentations 130 can be any suitable number of indentations on any suitable location on the bottom surface 112 of the base skid plate 110. The one or more indentations 130 are generally square shaped 131 to accommodate one or more buckles 115 from one or more fasteners 113 and to prevent the one or more buckles 115 from scratching the ground surface 103. Tr1*e* base skid plate 110, the pair of linear rails 120 and the one or more indentations 130 are molded together into a single piece of relatively heavy duty smooth plastic 100' to form the furniture skid plate 100. The furniture skid plate 100 is approximately 3 inches in length and 3 inches in width and forms a right triangle with an approximate 45 degree hypotenuse, although the furniture skid plate 100 can have other suitable dimensions and angles as well.

Figure 1B:
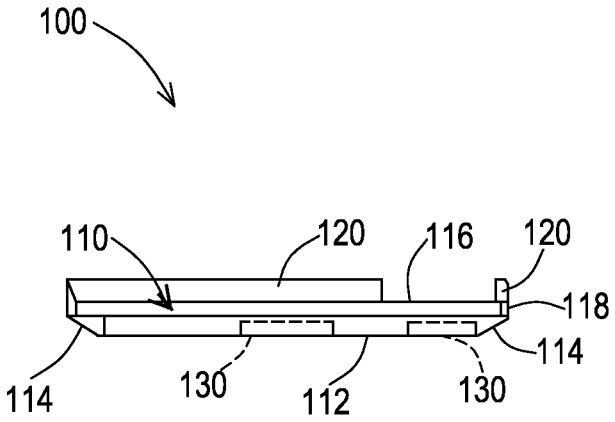
FIG. 1B illustrates a side view of a furniture skid plate, in accordance with one embodiment of the present invention.
Figure 1C:
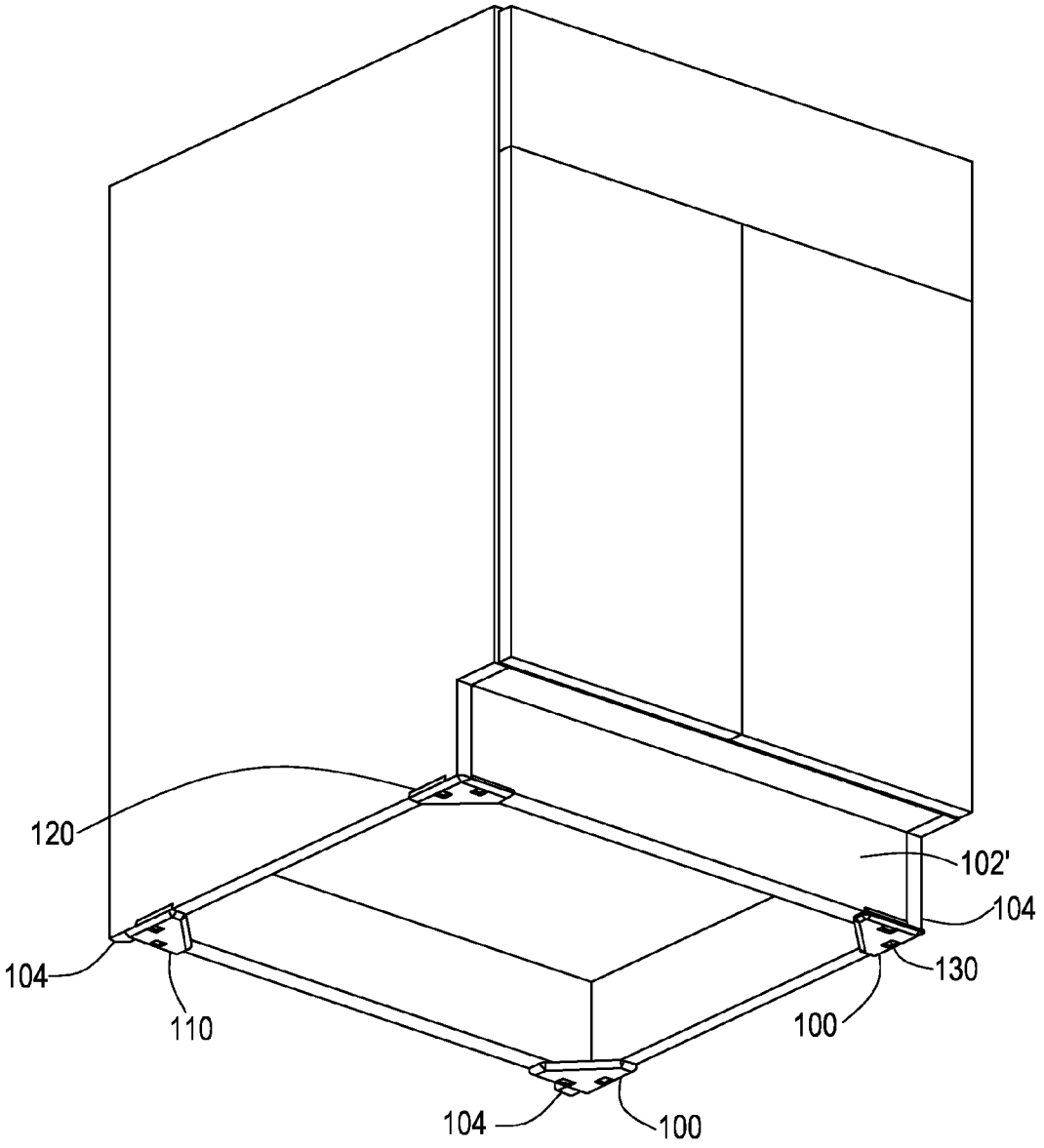
FIG. 1C illustrates an environmental bottom perspective view of a plurality of furniture skid plates, in accordance with one embodiment of the present invention.

FIG. 1B illustrates a side view of a furniture skid plate 100, in accordance with one embodiment of the present invention. The furniture skid plate 100 illustrated and described in FIG. 1B includes a base skid plate 110 that has a bottom surface 112 with a bottom beveled perimeter 114 and a top surface 116 with a top perimeter 118, a plurality of linear side rails 120 and one or more indentations 130 that is similar to the furniture skid plate 100, the base skid plate 110 that has a bottom surface 112 with a bottom beveled perimeter 114 and a top surface 116 with a top perimeter 118, the plurality of linear side rails 120 and the one or more indentations 130 illustrated and described in FIG. 1A. FIG. 1C illustrates an environmental perspective view of a plurality of furniture skid plates 100, in accordance with one embodiment of the present invention. FIG. 1C illustrates and describes 4 furniture skid plates 100 removably attached to each of 4 bottom corners 104 on a cabinet 102' being protected by the furniture skid plates 100. The furniture skid plate 100 illustrated and described in FIG. 1C and its description includes similar components as the furniture skid plate 100 illustrated and described in FIG. 1A and its description. The components include a base skid plate 110, pair of linear side rails 120 and one or more indentations 130 that is similar to the base skid plate 110, the pair of linear side rails 120 and the one or more indentations 130 illustrated and described in FIG. 1A.

The linear side rails 120 are molded to the top perimeter 118 of the base skid plate 110 and exert pressure on the bottom corner 104 of the piece of furniture 102 to allow the base skid plate 110 to be removably attached to the bottom corner 104 of the piece of furniture 102. The linear side rails 120 are approximately 2 inches in length, but can be any suitable length.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A furniture skid plate removably attachable to a piece of furniture, comprising: a generally triangular base skid plate having a generally flat bottom surface with a beveled perimeter and a top surface; a plurality of upwardly protruding side walls extending above said top surface of said base skid plate and positioned on adjoining sides of the skid plate, each of the plurality of upwardly protruding side walls having a longitudinal axis that have a single point of intersection, wherein the plurality of upwardly protruding side walls are separated by an entirely unobstructed opening proximate the point of intersection, wherein the entirely unobstructed opening allows a portion of a piece of furniture to extend beyond the generally triangular base skid plate proximate the point of intersection; at least one fastener; and at least one recessed indentation disposed in said bottom surface of said base skid plate receiving the at least one fastener in a recessed manner, wherein at least a portion of said at least one fastener is entirely surrounded on all sides by a region that defines said indentation so that the at least one fastener does not damage a surface about which the skid plate is slid, the at least one fastener being used to removably attach the base skid plate to the piece of furniture.

2. The furniture skid plate according to claim 1, wherein said side walls are linear side walls that protrude upward approximately ⅛ of an inch from the top surface of the base skid plate.

3. The furniture skid plate according to claim 2, wherein said linear side walls are approximately 2 inches in length.

4. A removable furniture skid plate for protecting a piece of furniture during transport, comprising: a generally triangular base skid plate comprising a generally flat bottom surface with a bottom beveled perimeter and a top surface with a top perimeter, wherein said base skid plate is removably attached on said bottom corners of said piece of furniture, the bottom surface defining a recess of sufficient depth receiving and surrounding a fastener on all sides such that the fastener does not protrude from the recess below the flat bottom surface of the skid plate and does not damage a surface about which the skid plate is slid; a plurality of upwardly-protruding linear side walls that are integral to said top perimeter of said base skid plate; an entirely unobstructed opening between the plurality of upwardly-protruding linear side walls, wherein the opening is proximate a largest angle formed by any two adjacent upwardly-protruding linear side walls of the plurality of upwardly protruding linear side walls and configured to allow at least a piece of furniture to pass through the opening beyond the top perimeter of the generally triangular base; and wherein upon transporting the furniture skid plate across a ground surface, said generally flat bottom surface of said furniture skid plate does not scratch said ground surface.

5. The furniture skid plate according to claim 4, wherein said linear side walls protrude upward approximately ⅛ of an inch above said top surface.

6. The furniture skid plate according to claim 4, wherein said linear side walls are approximately 2 inches in length.

7. The furniture skid plate according to claim 4, further comprising a fastener disposed in the recess defined by the bottom surface of the skid plate to connect the skid plate to a portion of furniture to secure the skid plate to the furniture so that the skid plate remains connected to the furniture as the furniture is moved along a ground surface.

8. The furniture skid plate according to claim 4, further comprising the piece of furniture, wherein the piece of furniture comprises at least one of a cabinet and a dresser.

9. The furniture skid plate according to claim 4, wherein said ground surface is a floor.

10. A generally triangular skid plate for transporting a piece of furniture, wherein edges of the triangular skid plate form a hypotenuse and two legs, the skid plate comprising: a base member having a plurality of upwardly-extending protrusions, at least two side-facing openings positioned between the plurality of upwardly-extending protrusions, wherein a first opening extends along at least one of the two legs and a second opening extends along the hypotenuse, wherein both the first and second openings are configured as entirely unobstructed passageways through which portions of a piece of furniture can protrude beyond the base member, and a generally flat bottom sliding surface; and at least one recess disposed in the bottom sliding surface of the base member with the base member forming side surfaces and an upper surface that surround and define the at least one recess so the at least one recess is receiving a fastener to be inserted therein without protruding beyond the generally flat bottom sliding surface of the base member so that the generally flat sliding surface and at least one recess are configured to allow the skid plate to slide across a ground surface without the fastener disposed therein damaging the ground surface.

11. The generally triangular skid plate of claim 10 wherein the generally flat bottom sliding surface has a bevel to allow the generally triangular skid plate to slide along various types of ground surfaces.

12. The generally triangular skid plate of claim 11 wherein the base member, upwardly extending protrusion and at least one recess are molded into a single piece of heavy duty plastic.

13. The furniture skid plate according to claim 1, further comprising a fastener disposed in the recessed indentation in said bottom surface of said base skid plate to connect said base skid plate to a portion of furniture to secure said base skid plate to the furniture so that said base skid plate remains connected to the furniture as the furniture is moved along a ground surface.

14. The furniture skid plate according to claim 1, wherein said recessed indentation is generally rectangular in shape and aligned adjacent to the beveled perimeter.

15. The furniture skid plate according to claim 14, further comprising a plurality of recessed indentations, wherein said plurality of recessed indentations are aligned adjacent to the beveled perimeter.

16. The furniture skid plate according to claim 4, wherein said recess is generally rectangular in shape and aligned adjacent to the beveled perimeter.

17. The furniture skid plate of claim 16, further comprising a plurality of recesses, wherein said plurality of recesses are aligned adjacent to beveled perimeter.

18. The generally triangular skid plate of claim 10, wherein the fastener is centrally disposed within the recess in the bottom sliding surface of the base member to connect the skid plate to a portion of furniture to secure the skid plate to the furniture so that the skid plate remains connected to the furniture as the furniture is moved along a ground surface.

19. The generally triangular skid plate of claim 11 wherein the at least one recess is aligned adjacent to the bevel.

20. The generally triangular skid plate of claim 19 further comprising a plurality of recesses, wherein the plurality of recesses are aligned adjacent to the bevel.

21. The generally triangular skid plate of claim 10, wherein the first opening extends along the at least one of the two legs at a point of intersection between the two legs.

* * * * *